US009748031B2

(12) United States Patent
Sasaki

(10) Patent No.: US 9,748,031 B2
(45) Date of Patent: Aug. 29, 2017

(54) INDUCTOR AND METHOD OF MANUFACTURING INDUCTOR

(71) Applicant: Sumida Corporation, Tokyo (JP)

(72) Inventor: Naoki Sasaki, Natori (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 14/694,203

(22) Filed: Apr. 23, 2015

(65) Prior Publication Data

US 2015/0325354 A1 Nov. 12, 2015

(30) Foreign Application Priority Data

May 9, 2014 (JP) ..... 2014-097616

(51) Int. Cl.

| | |
|---|---|
| ***H01F 27/26*** | (2006.01) |
| ***H01F 27/30*** | (2006.01) |
| ***H01F 27/24*** | (2006.01) |
| ***H01F 7/06*** | (2006.01) |
| ***H01F 17/04*** | (2006.01) |
| ***H01F 41/02*** | (2006.01) |

(52) U.S. Cl.

CPC ..... *H01F 27/263* (2013.01); *H01F 17/041* (2013.01); *H01F 27/306* (2013.01); *H01F 41/02* (2013.01); *Y10T 29/49075* (2015.01)

(58) Field of Classification Search

CPC ..... H01F 41/02; H01F 17/041; H01F 27/036; H01F 27/263; H01F 27/325; H01F 27/26; H01F 5/02; H01F 2005/022; H01F 2005/043; H01F 2005/046

USPC ..... 336/198, 208, 212, 210; 29/606

See application file for complete search history.

(56) References Cited

U.S. PATENT DOCUMENTS

| | | | | |
|---|---|---|---|---|
| 3,007,125 | A * | 10/1961 | Furbee | H01F 30/10 336/192 |
| 5,264,815 | A * | 11/1993 | Umeya | H01F 5/04 24/329 |
| 5,448,216 | A * | 9/1995 | Kuze | H01F 5/04 336/170 |
| 5,592,138 | A * | 1/1997 | Tobben | H01F 27/263 336/210 |
| 2008/0024262 | A1* | 1/2008 | Chang | H01F 27/02 336/208 |
| 2009/0231079 | A1* | 9/2009 | Uchiyama | H01F 5/04 336/192 |
| 2010/0176907 | A1* | 7/2010 | Hayasaki | H01F 27/33 336/220 |

FOREIGN PATENT DOCUMENTS

| | | | |
|---|---|---|---|
| CN | 2849923 | Y | 12/2006 |
| JP | 05-028012 | U | 4/1993 |
| JP | H09-134826 | A | 5/1997 |

* cited by examiner

*Primary Examiner* — Mangtin Lian

(74) *Attorney, Agent, or Firm* — Harness, Dickey & Pierce, P.L.C.

(57) ABSTRACT

An inductor (100) includes a pair of magnetic members (cores (10, 20)), a main body having coils (71, 72), and a sheet-formed fixation member (60), wherein the fixation member (60) is bound across the cores (10, 20) and the main body, to thereby fix the cores (10, 20) which configure a closed magnetic path, and to thereby fix at least one of the cores (10, 20) to the main body.

12 Claims, 11 Drawing Sheets

INDUCTOR AND METHOD OF MANUFACTURING INDUCTOR

This application is based on Japanese patent application No. 2014-097616, filed on May 9, 2014, the content of which is incorporated hereinto by reference.

BACKGROUND

Technical Field

The present invention relates to an inductor used in particular for transformer, and a method of manufacturing the inductor.

Related Art

There has been known an inductor having a plurality of cores assembled to configure a closed magnetic path, wherein the plurality of cores are fixed by winding a tape around them. This sort of inductor is typically disclosed in JP-U-H05-28012.

According to JP-U-H05-28012, the plurality of cores have trenches provided on the outer circumferential surfaces thereof, and are fixed in an abutted manner by winding the tape while guided by the trench. By virtue of provision of the trench, positional variation of winding may be suppressed, and workload of a worker who winds up the tape may be reduced.

When a closed magnetic path is formed in this sort of inductor by inserting a part of the core into the coil, only a simple winding of the tape will fail to prevent relative positional shift of the coil and the core, and will fail to achieve target specification. It is therefore necessary to take some steps to fix the relative positional relation.

It has therefore been necessary to spend some additional workload and to prepare a specialized jig used for such work for every product, which has caused a problem from the viewpoint of productivity.

SUMMARY

The present invention was conceived to solve the problems described above, and an object thereof is to provide an inductor which contributes to improve the productivity, and a method of manufacturing such inductor.

According to the present invention, there is provided an inductor which includes a pair of magnetic members, and a main body having a coil configured by a wound wire, a rod-like insertion part of one magnetic member, out of the pair of magnetic members, being inserted into the coil, the one magnetic member being combined with the other magnetic member to configure a closed magnetic path, and, the closed magnetic path including as a part thereof the insertion part, the inductor further includes a sheet-formed fixation member, the fixation member being bound across the one magnetic member and the other magnetic member and the main body, to thereby fix the one magnetic member to the other magnetic member, both configuring the closed magnetic path, and to thereby fix at least one of the pair of magnetic members to the main body.

According to the present invention, there is also provided a method of manufacturing an inductor which has a pair of magnetic members, and a main body having a coil configured by a wound wire, the method includes: configuring a closed magnetic path, by inserting a rod-like insertion part of one magnetic member, out of the pair of magnetic members, into the coil, and combining the one magnetic member with the other magnetic member to configure a closed magnetic path which includes as a part thereof the insertion part; and fixing the closed magnetic path, by binding a sheet-formed fixation member across the one magnetic member and the other magnetic member and the main body, to thereby fix the one magnetic member to the other magnetic member, both configuring the closed magnetic path, and to thereby fix at least one of the pair of magnetic members to the main body.

When the present invention is applied, a single fixation member (i) binds and fixes one magnetic member to the other magnetic member, and (ii) binds and fixes at least one of the pair of magnetic members to the main body, so that relative shift in position of the pair of magnetic members and the main body may be suppressed. Accordingly, in the process of fixing the relative position of the magnetic member and the coil, the positional shift may be suppressed in a successful manner, and the workload required for the process may be reduced.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

Figure 1:
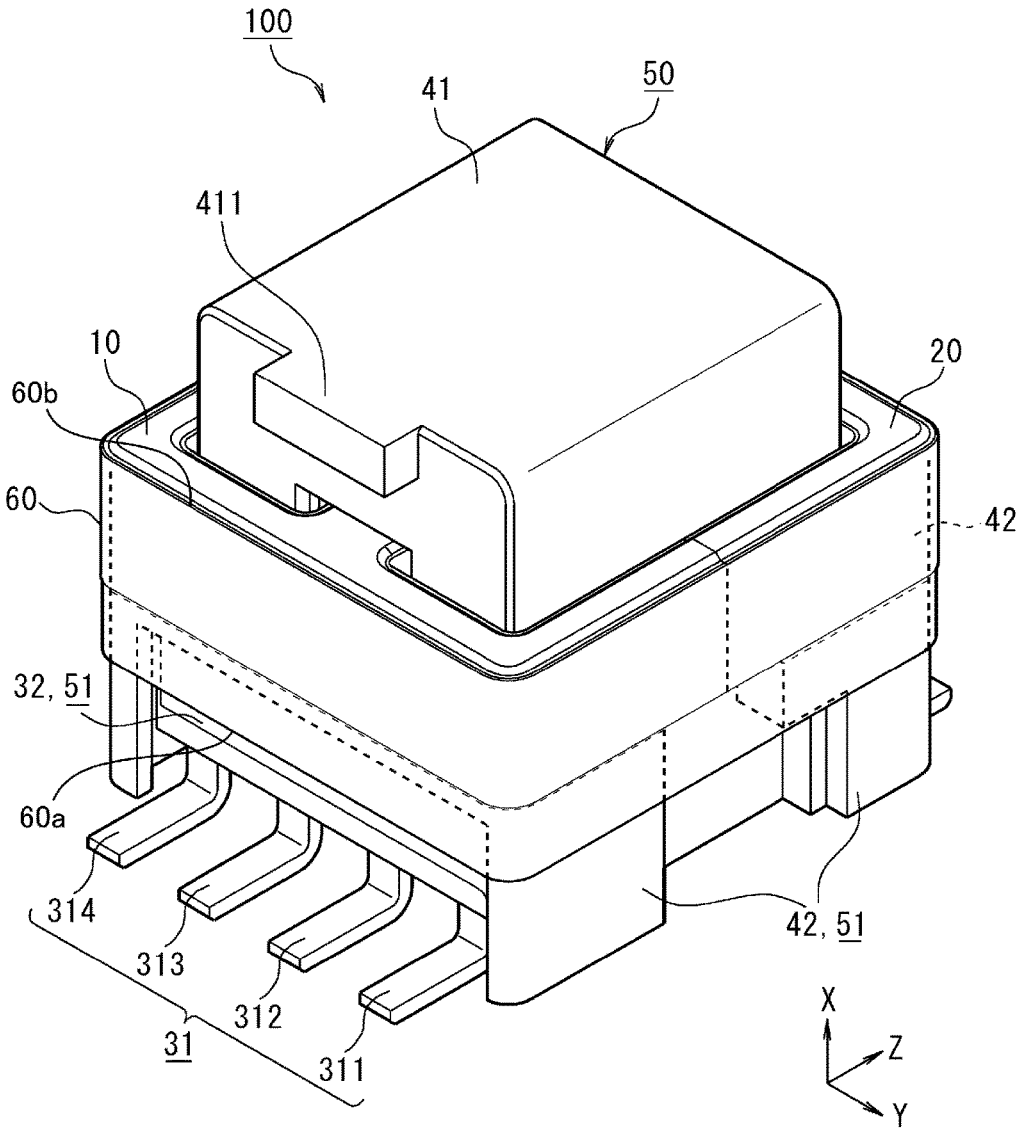
FIG. 1 is a perspective view illustrating an inductor of a first embodiment viewed from the negative side on Z-axis.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Embodiments of the present invention will be explained referring to the attached drawings. In all drawings, all identical constituents will be given the same reference numerals and/or symbols, so as to avoid repetitive explanation for the convenience.

Various directions in this embodiment will be explained according to a rectangular coordinate system represented by X-axis, Y-axis and Z-axis indicated in the individual drawings, unless otherwise specifically noted. X-axis lies in the vertical direction of the inductor when mounted on a board (not illustrated), where the direction from the bottom towards the top in FIG. 1 is defined as the positive direction. Z-axis lies in the longitudinal direction of the coil 70 (coil 71 and coil 72), where the direction from lower left towards upper right in FIG. 1 is defined as the positive direction. Y-axis lies in the direction vertical to X-axis and Z-axis, where the direction from lower left towards upper right in FIG. 1 is defined as the positive direction.

First Embodiment

An inductor 100 of the first embodiment will be outlined referring to FIG. 1, FIG. 2, FIG. 5 and FIG. 6.

Figure 2:
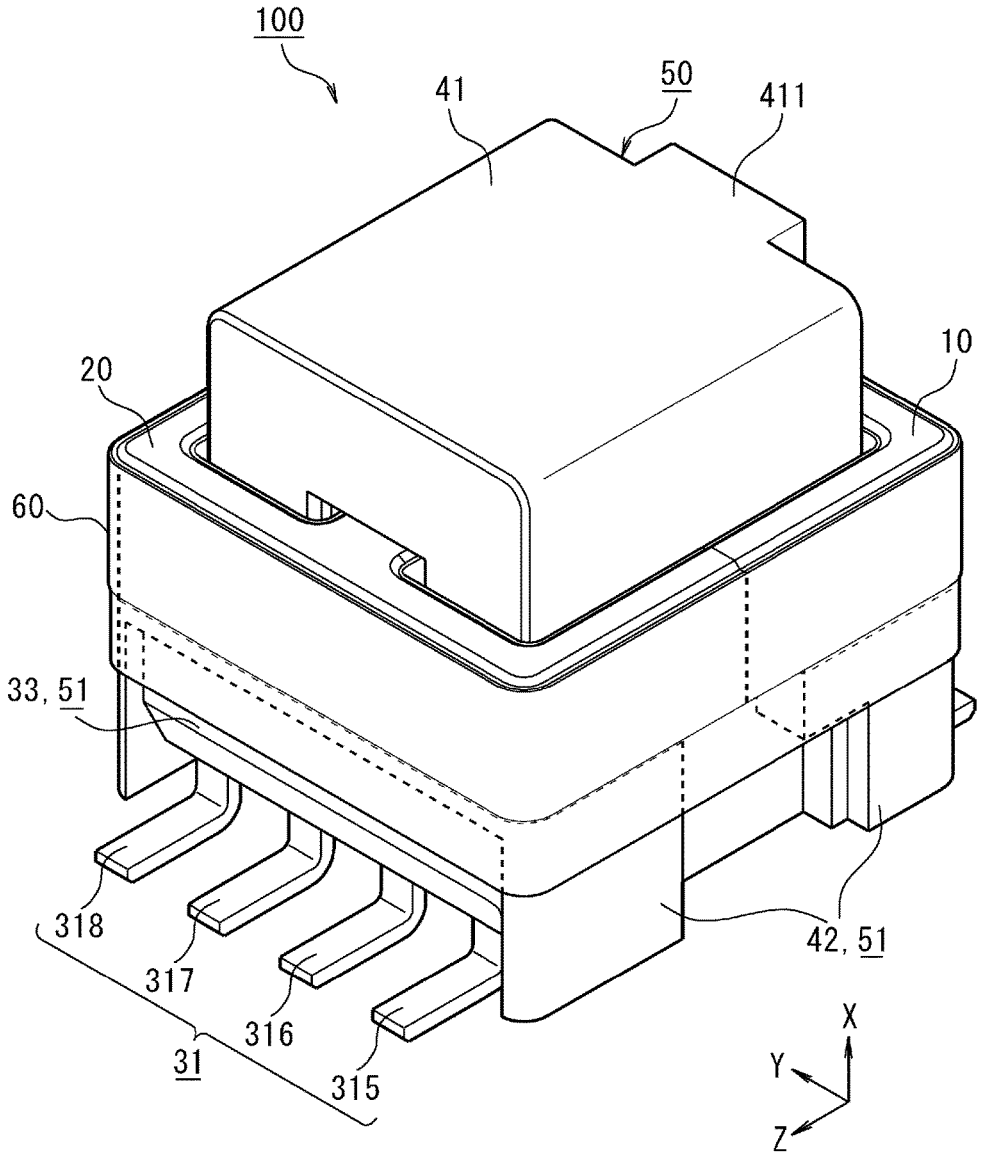
FIG. 2 is a perspective view illustrating the inductor of the first embodiment viewed from the positive side on Z-axis.
Figure 5:
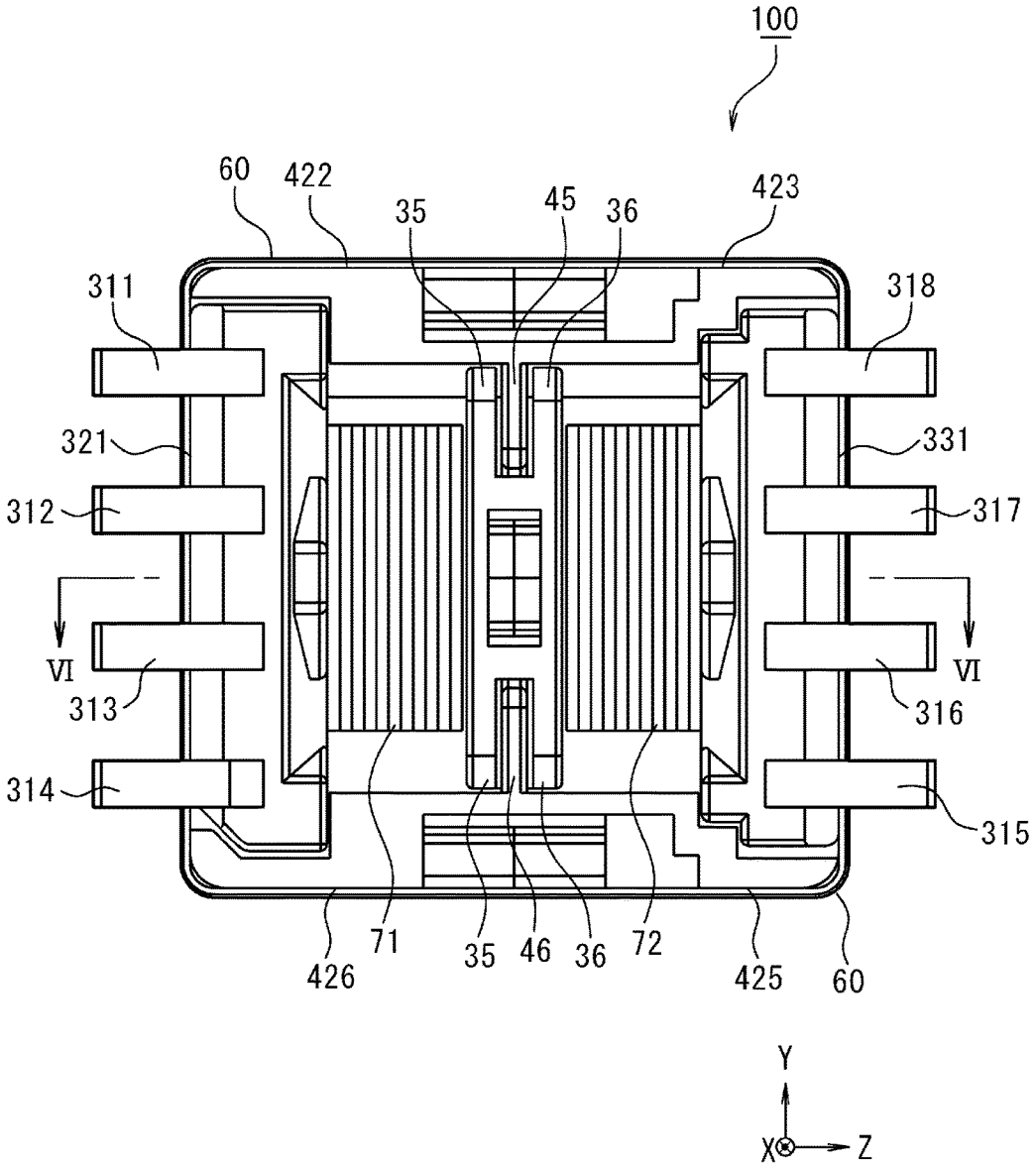
FIG. 5 is a bottom view of the inductor.
Figure 6:
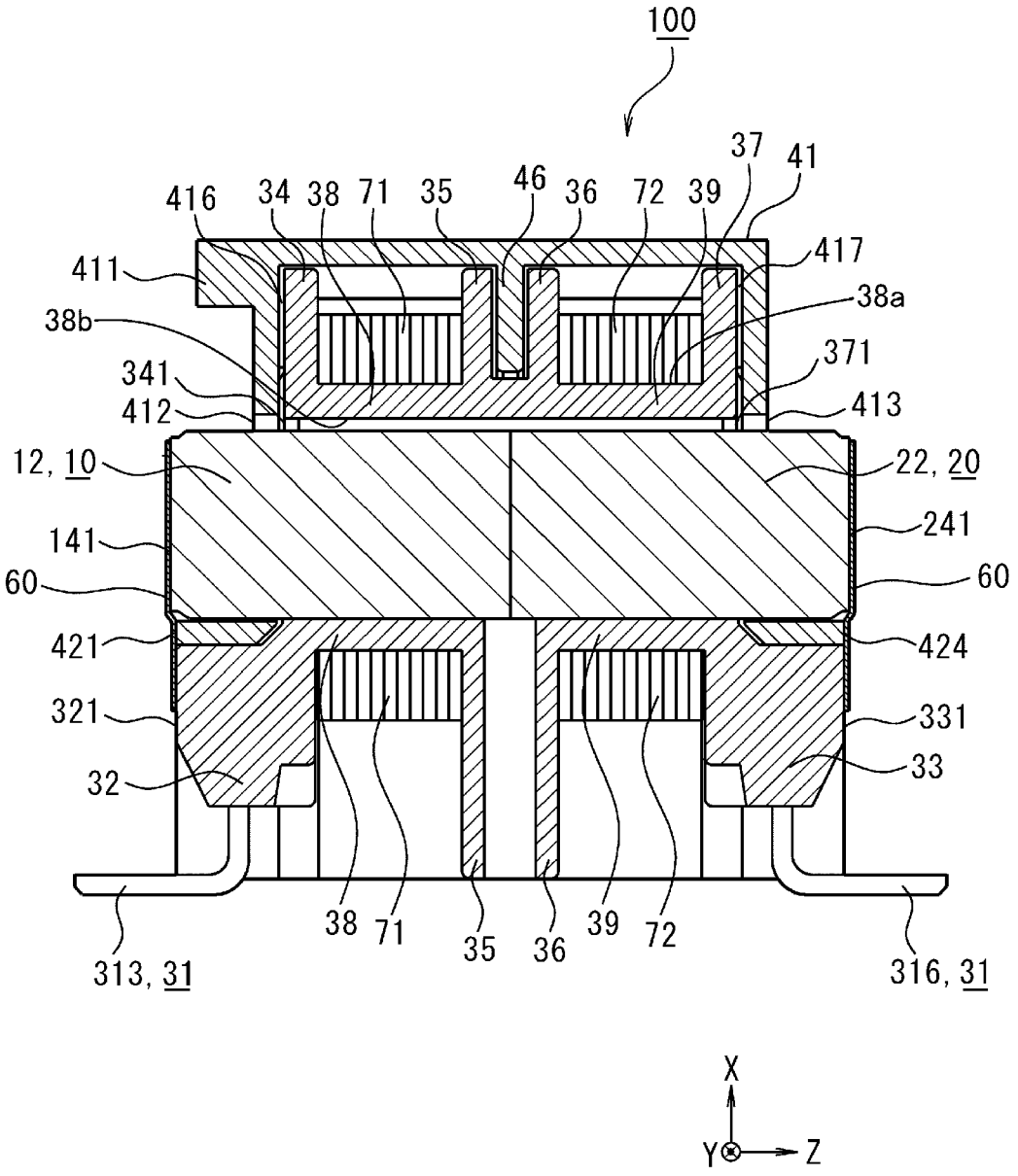
FIG. 6 is a cross-sectional view taken along line VI-VI in FIG. 5.

FIG. 1 is a perspective view illustrating the inductor 100 of the first embodiment viewed from the negative side on Z-axis. FIG. 2 is a perspective view illustrating the inductor 100 of the first embodiment viewed form the positive side on Z-axis. FIG. 5 is a bottom view of the inductor 100. FIG. 6 is a cross-sectional view taken along line VI-VI in FIG. 5.

The inductor 100 has a pair of magnetic members (core 10 and core 20), and main body 50 having a coil 71 and a coil 72 configured by a wound wire. A rod-like insertion part 12 of one magnetic member (core 10), out of the pair of magnetic members, is inserted into the coil 71. A rod-like insertion part 22 of the other magnetic member (core 20), out of the pair of magnetic members, is inserted into the coil 72. The core 10 and the core 20 are combined to configure a closed magnetic path, and, the closed magnetic path includes as a part thereof the insertion parts 12, 22.

The inductor 100 further includes a sheet-formed fixation member 60. The fixation member 60 is bound across the core 10 and the core 20 and the main body 50, to thereby fix the core 10 and the core 20, both configuring the closed magnetic path, and to thereby fix at least one of the core 10 and the core 20 to the main body 50.

With such configuration, the fixation member 60 can fix the pair of magnetic members (core 10 and core 20) and the main body 50 together.

Now, the inductor 100 refers to an article having a portion (coil 70, for example) in which inductance generates when supplied with electric current. While such portion in the inductor 100 of this embodiment is divided into two (coil 71 and coil 72), this is not essential. In other words, the potion may be configured by a single coil, or by three or more coils. Applications of the inductor 100 are exemplified by transformer and choke coil.

Now, the phrase of "the fixation member 60 is bound" means that the fixation member 60 is connected to a target member, and also encompasses the case where the fixation member 60 is adhered using an adhesive, and the case where the fixation member 60 is attracted with the aid of frictional force, magnetic force or static electricity.

In this embodiment, the fixation member 60 has first and second sides 60*a* and 60*b* as shown in FIG. 1. The first and second sides 60*a* and 60*b* provided along the longitudinal direction of the fixation member 60 lie in the YZ-plane, and the widthwise direction of the fixation member 60 lies in the X-axis direction.

Both of the core 10 and the core 20, which are the pair of magnetic members, have an E shape, and have the insertion part 12 inserted into the coil 71, and the insertion part 22 inserted into the coil 72. The pair of magnetic members in the present invention are not only those having a combination of E-shape core and E-shape core, but may also be those having a combination of E-shape core and I-shape core. It consequently suffices that at least one of the magnetic members has a portion equivalent to the insertion part 12 or the insertion part 22.

With the features described above, a single fixation member 60 (i) can bind and fix the core 10 and the core 20, and (ii) can bind and fix at least one of the core 10 and the core 20 with the main body 50, so that relative shift in position of the pair of magnetic members and the main body may be suppressed. Accordingly, in the process of fixing the relative position of the core 10 and the coil 71, or, relative position of the core 20 and the coil 72, such positional shift may be suppressed in a successful manner, and the workload required for the process may be reduced.

<Coil 70 and Main Body 50>

Next, the coil 70 and the main body 50 will be described referring to FIG. 1 to FIG. 8.

Figure 3:
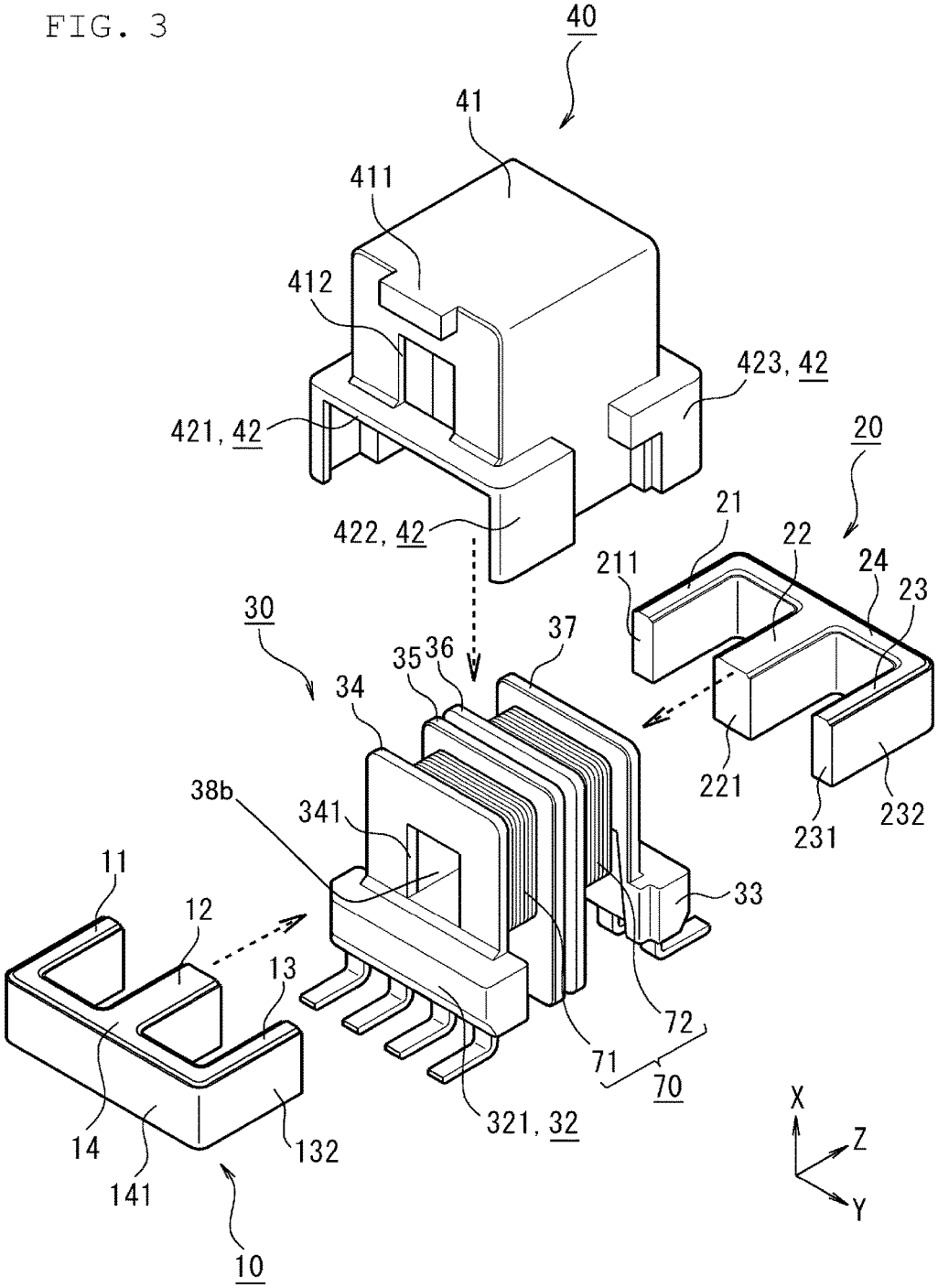
FIG. 3 is an exploded view of the inductor viewed from the direction corresponded to FIG. 1.
Figure 4:
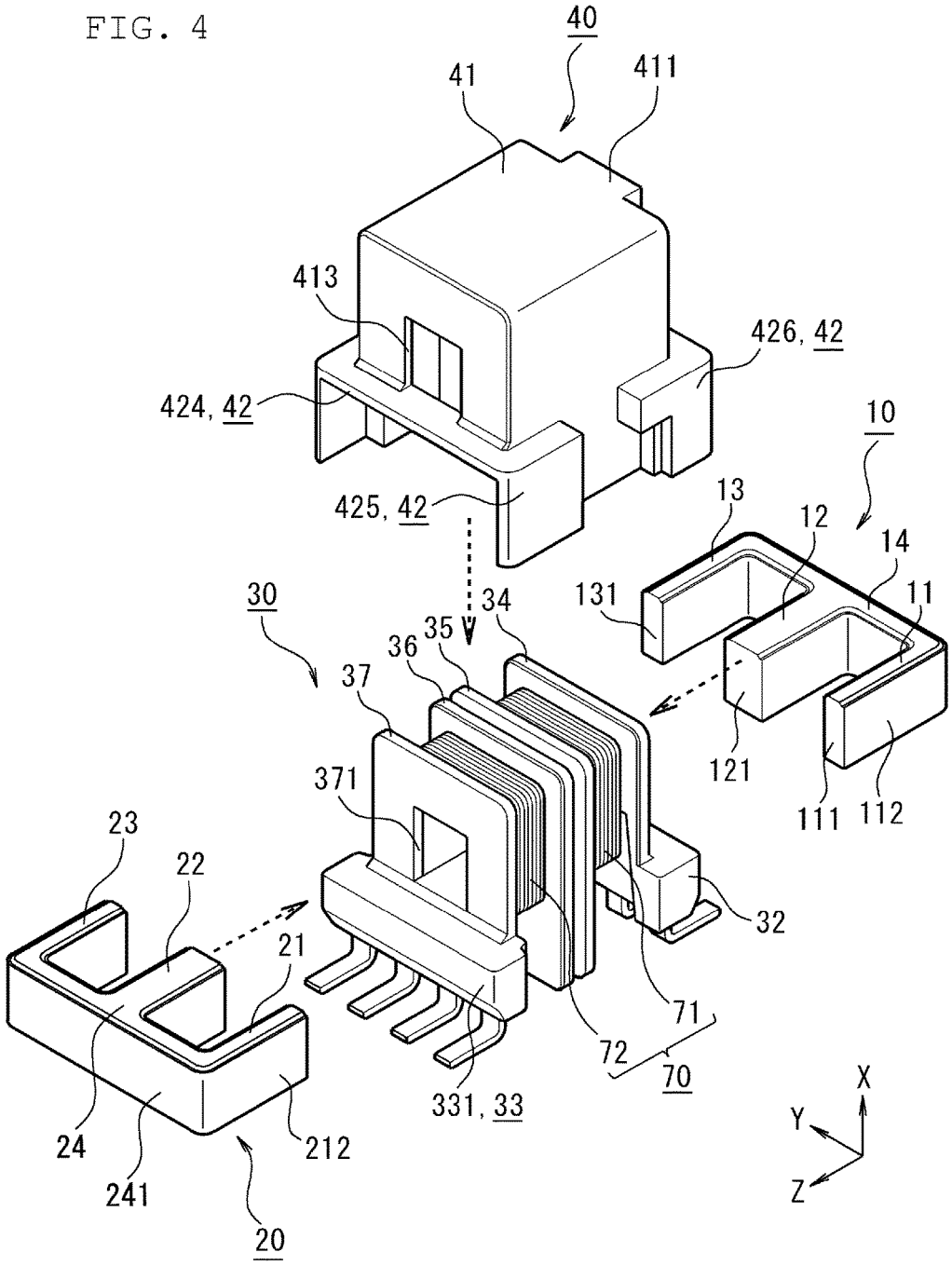
FIG. 4 is an exploded view of the inductor viewed from the direction corresponded to FIG. 2.
Figure 7A:
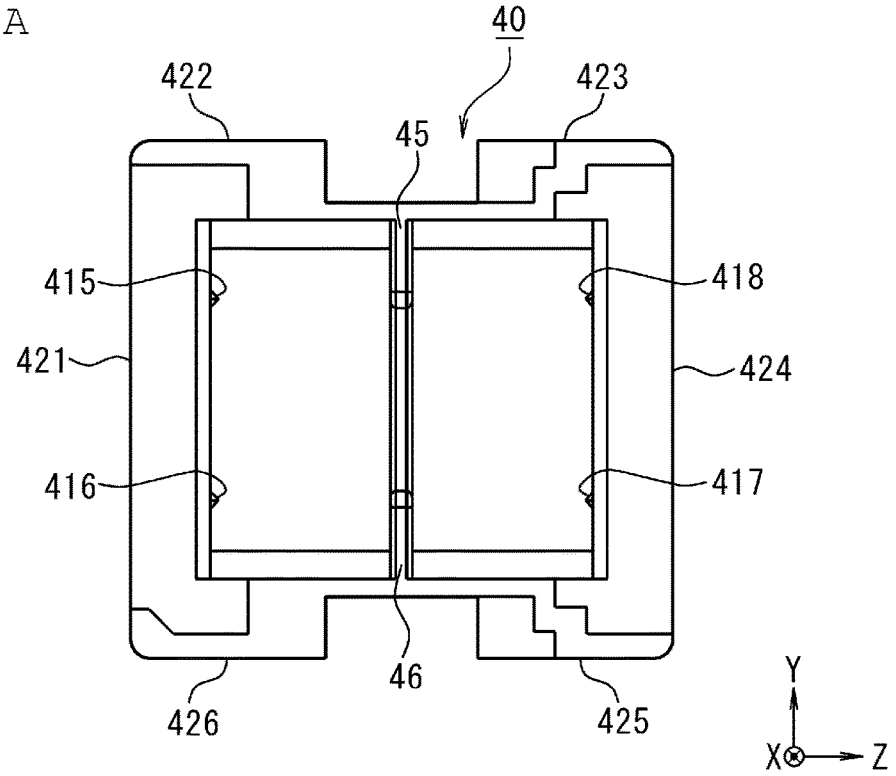
FIG. 7A is a bottom view of a second member.
Figure 7B:
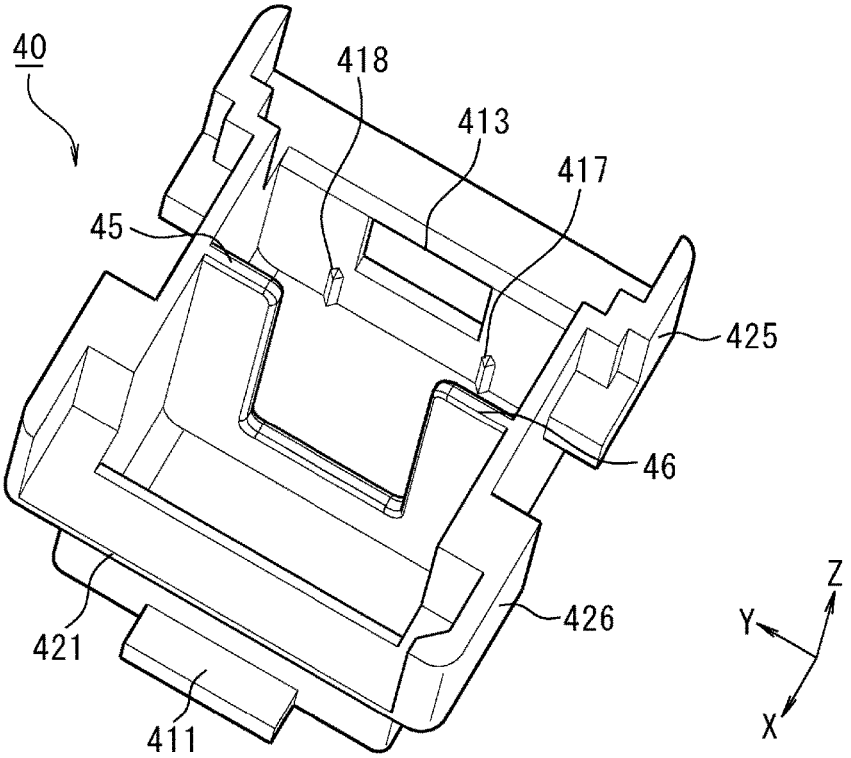
FIG. 7B is a perspective view of the second member viewed from the bottom.
Figure 8:
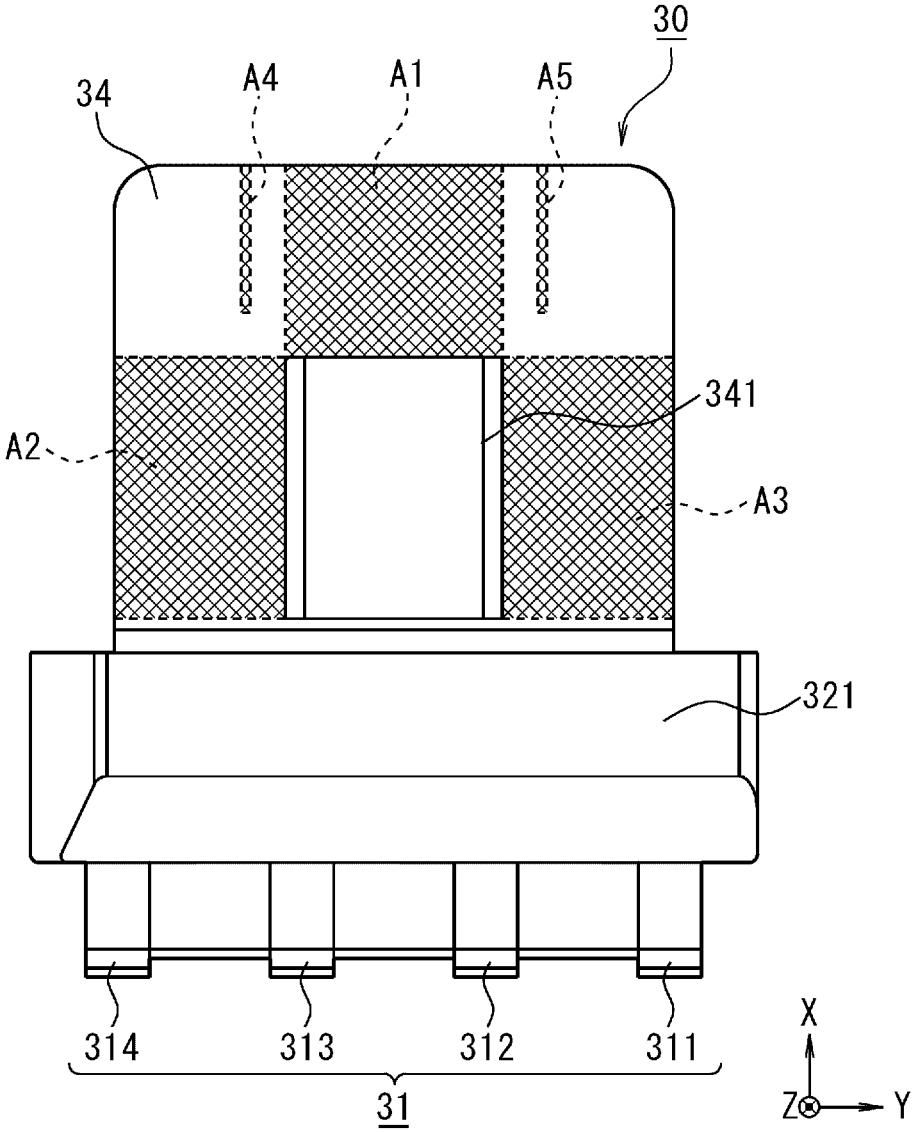
FIG. 8 is a schematic drawing illustrating positions where an end part of a bobbin part is brought into contact with ribs.

FIG. 1 is a perspective view illustrating the inductor 100 of the first embodiment viewed from the negative side on Z-axis. FIG. 2 is a perspective view illustrating the inductor 100 of the first embodiment viewed from the positive side on Z-axis. FIG. 3 is an exploded view of the inductor 100 viewed from the direction corresponded to FIG. 1. FIG. 4 is an exploded view of the inductor 100 viewed from the direction corresponded to FIG. 2. FIG. 5 is a bottom view of the inductor 100. FIG. 6 is a cross-sectional view taken along line VI-VI in FIG. 5. FIG. 7A is a bottom view of a second member 40. FIG. 7B is a perspective view of the second member 40 viewed from the bottom. FIG. 8 is a schematic drawing illustrating positions where an end part 34 of a bobbin part 38 is brought into contact with ribs 415, 416.

The main body 50 is a constituent of the inductor 100 which includes at least the coil 70 (coil 71 and coil 72) and a member which houses the coil 70. In this embodiment, the member which houses the coil 70 includes the bobbin part 38, a bobbin part 39, a base part 51 and a cover part 41. The main body 50 in this embodiment also includes, besides the above-described parts, a plurality of terminal parts 31 (311 to 318).

The main body 50 in this embodiment has a first member 30 and the second member 40. The main body 50 is configured by winding a winding wire around the bobbin parts 38, 39 to form the coil 70, then by combining the first member 30 and the second member 40, and further by covering the coil 70 with the cover part 41.

The configuration of the main body 50 illustrated here is merely an example, and may be modified in various ways. For example, the may body 50 may be configured by a single member, or may be configured by combining three or more members.

The coil 70 includes the coil 71 disposed on the core 10 side (more negative side on Z-axis), and the coil 72 disposed on the core 20 side (more positive side on Z-axis). The coil 71 and the coil 72 are equally parted by a partition part 35 and a partition part 36.

The coil 71 is connected to four terminal parts 311 to 314 disposed on the core 10 side. The coil 72 is connected to four terminal parts 315 to 318 disposed on the core 20 side.

The first member 30 is made of a thermosetting resin such as phenol resin, or thermoplastic resin, and is an electrical insulator, so that the coil 71 and the coil 72 are electrically isolated by the partition part 35 and the partition part 36. Since the coil 71 and the coil 72 share a single closed magnetic path, so that when current flows in one of them, the current flows in the other by mutual induction.

With such configuration, the inductor 100 is applicable to transformer, choke coil and so forth. The number of turns of the coil 71 and the coil 72, and types of the winding wire are selectable depending on target specifications of the inductor 100.

The cover part 41 has a projection part 411 provided on the core 10 side, but has no part equivalent to the projection part 411 on the core 20 side. The projection part 411 is provided to allow the user to externally identify the arrangement of the coil 71 and the coil 72 which are invisible under the cover part 41. When the inductor 100 is mounted on a board (not illustrated), directionality of mounting may be determined with reference to the projection part 411.

In a gap between the partition part 35 and the partition part 36, there are formed a partition part 45 and a partition part 46, provided in the second member 40, so as to fall therein. The second member 40 is made of a thermoplastic resin such as nylon, or a thermosetting resin, and is an electric insulator, so that also the partition part 45 and the partition part 46 serve to keep a creepage distance necessary for electrically isolating the coil 71 and the coil 72. The partition part 45 and the partition part 46, held between the partition part 35 and the partition part 36 so as to properly function as described above, also function to prevent positional shift between the first member 30 and the second member 40 in the X-axis direction.

The first member 30 includes the bobbin part 38 and the bobbin part 39.

The bobbin part 38 is a hollow tubular article having the coil 71 formed on the exterior thereof, i.e., on an outer surface 38*a* of the bobbin part 38 as shown in FIG. 6, and having the insertion part 12 inserted therein, i.e., into an inside of an inner surface 38*b* of the bobbin part 38 as shown in FIGS. 3 and 6. The bobbin part 38 is flanged at the end part 34. The bobbin part 39 is a hollow tubular article having the coil 72 formed on the exterior thereof, and having the insertion part 22 inserted therein. The bobbin part 39 is flanged at the end part 37.

The second member 40 has ribs 415, 416 on the inner wall of the cover part 41, which are provided so as to oppose with the end part 34, and so as to protrude from the inner wall towards the end part 34. The second member 40 also has ribs 417, 418 on the inner wall of the cover part 41, which are provided so as to oppose with an end part 37, and so as to protrude from the inner wall towards the end part 37.

The second member 40 is press-fitted onto the first member 30 along the end part 34 and the end part 37, so that the end part 34 is brought into close contact with the ribs 415, 416, and the end part 37 is brought into close contact with the ribs 417, 418. With such configuration, the first member 30 and the second member 40 are prevented from shifting in the Z-axis direction.

The ribs 415 to 418 are tapered towards the end parts 34, 37, that is, thinned from the base ends towards the tips. With such geometry, the ribs 415 to 418 per se will be given a sufficient level of strength, and will smoothen the press-fitting of the second member 40 to the first member 30.

FIG. 8 illustrates areas A4, A5 where the ribs 415, 416 are brought into close contact with the end part 34.

The end part 34 includes an opening 341 through which the insertion part 12 is inserted. The ribs 415, 416 extend nearly linearly along the inner wall of the cover part 41.

As illustrated in FIG. 8, the areas A4, A5 reside outside of the area A1 which falls beyond the opening 341 in the direction of press-fitting of the second member 40 (X-axis direction). The areas A4, A5 also reside outside of areas A2, A3 which fall beyond the opening 341 in the direction normal to the direction of press-fitting of the second member 40 (Y-axis direction). In other words, the positions where the ribs 415, 416 reside fall outside of the opening 341 at the end part 34, when viewed whichever from the direction of press-fitting of the second member 40, or from the direction normal to the direction of press-fitting.

Now "outside of the opening 341" means areas which do not overlap the opening 341 when viewed from a predetermined direction which lies along the end part 34.

Similarly to the end part 34, also the end part 37 includes an opening through which the insertion part 22 is inserted. Similarly to the ribs 415, 416, again the ribs 417, 418 extend nearly linearly along the inner wall of the cover part 41, and positions where the ribs 417, 418 reside fall outside of the opening 371 at the end part 37, when viewed whichever from the direction of press-fitting of the second member 40, or from the direction normal to the direction of press-fitting.

As described above, the ribs 415 to 418 are brought into close contact with the first member 30. Accordingly, even if the second member 40, after press-fitted to the first member 30, should shift in the X-axis direction or in the Y-axis direction, the ribs 415, 416 will not reach the opening 341, and the ribs 417, 418 will not reach the opening 371. Accordingly, in the process of press-fitting, the load possibly applied by the ribs 415 to 418 to the end parts 34, 37 will not be concentrated in the vicinities of the openings 341, 371, and thereby the end parts 34, 37 are prevented from deforming. As a consequence, with such arrangement of the ribs 415 to 418 described above, it is ensured that the insertion parts 12, 22 may smoothly be inserted into the openings 341, 371.

The first member 30 has a leg part 32 having the base ends of the terminal parts 311 to 314 embedded therein, and a leg part 33 having the base ends of the terminal parts 315 to 318 embedded therein. The second member 40 includes, besides the cover part 41 described above, the cover skirt 42 which is positioned below the cover part 41 and protrudes out from the cover part 41 in the Y-axis direction and in the Z-axis direction. The cover skirt 42 embraces the leg part 32 and the leg part 33. The second member 40 is press-fitted to the first member 30, deeply until the top face of the inner wall of the cover skirt 42 and the top faces of the outer walls of the leg part 32 and the leg part 33 are brought into contact.

In other words, the top face of the inner wall of the cover skirt 42 and the top faces of the outer walls of the leg part 32 and the leg part 33 serve as the reference faces for the process of press-fitting of the second member 40 to the first member 30.

<Closed Magnetic Path Configured in Inductor 100>

The second member 40 has openings 412, 413 provided to the cover part 41, at positions opposed to the openings 341, 371. The insertion part 12 is inserted through the opening 412 and the opening 341 into the bobbin part 38. The insertion part 22 is inserted through the opening 413 and the opening 371 into the bobbin part 39.

Next, a closed magnetic path configured in the inductor 100 will be described referring to FIG. 9.

Figure 9:
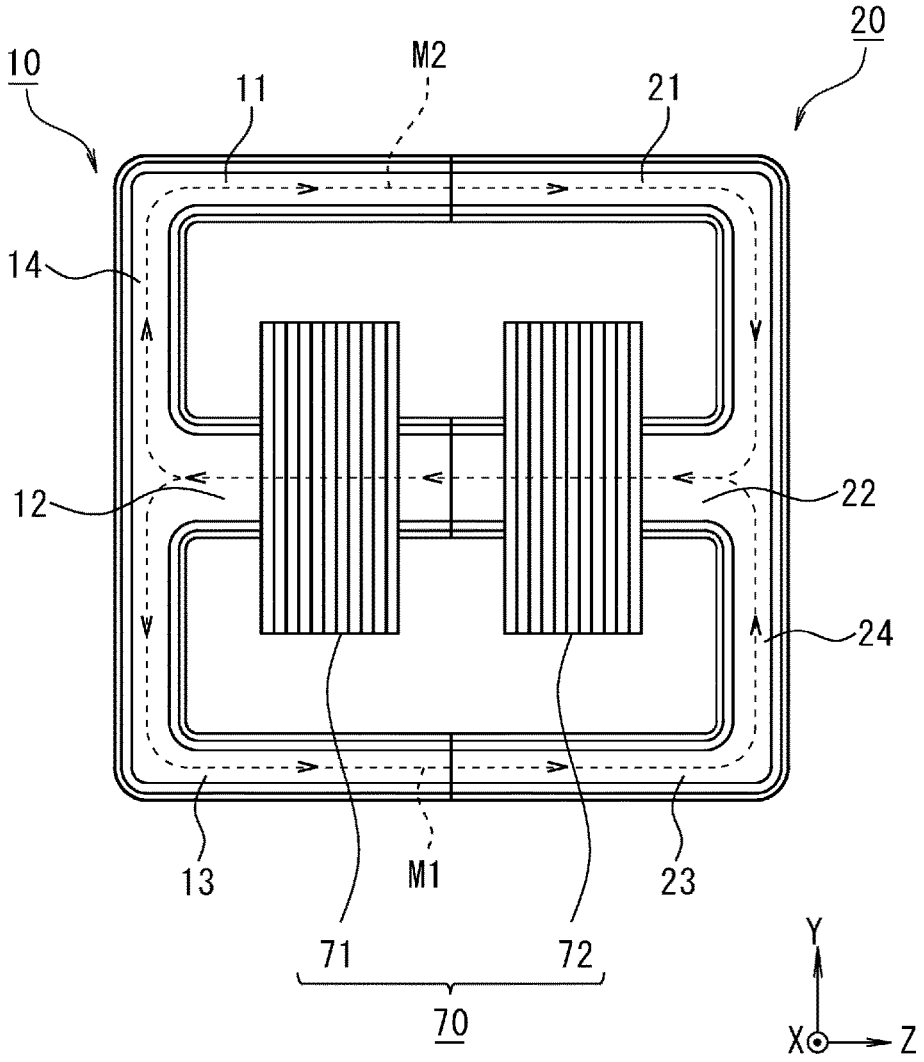
FIG. 9 is a schematic drawing illustrating a closed magnetic path configured by coils and cores.

FIG. 9 is a schematic drawing illustrating the closed magnetic path configured by the coil 70 and the cores 10, 20. In more details, FIG. 9 is a schematic drawing of the inductor 100, from which the constituents other than the cores 10, 20 and the coil 70 are removed, virtually illustrating an electromagnetic field generated when the coil 70 is supplied with electric power.

Now the closed magnetic path means a closed loop of magnetic path geometrically approximated to the magnetic member, formed by shielding magnetic flux which generates from the coil 70 intrinsically in a divergent manner, by the magnetic members (core 10 and core 20) provided around the coil 70, to thereby converge the magnetic path of such magnetic flux into the magnetic member.

The phrase of "closed magnetic path is configured" means that the coil 70 is given a form capable of configuring the closed magnetic path when supplied with electric power. More specifically, the core 10 and the core 20 are designed, when combined, to form a frame (including those having annular, polygonal or other shapes), sphere, box or the like, in which the coil 70 may be embraced.

As illustrated in FIG. 9, the core 10 and the core 20 have an alphabetical "E" shape and an inverted "E" shape, respectively, when viewed in the X-axis direction. The core 10 is configured by an outer frame part 11, the insertion part 12, outer frame part 13 and an outer frame part 14. Of these constituents, the insertion part 12 is inserted into the coil 71, whereas the outer frame part 11, the outer frame part 13 and the outer frame part 14 are disposed outside the coil 71. The core 20 is configured by an outer frame part 21, the insertion part 22, an outer frame part 23 and an outer frame part 24. Of these constituents, the insertion part 22 is inserted into the coil 72, whereas the outer frame part 21, the outer frame part 23 and the outer frame part 24 are disposed outside the coil 72.

When the core 10 and the core 20 are combined, an end face 111 of the outer frame part 11 and the end face 211 of the outer frame part 21, an end face 121 of the insertion part 12 and the end face 221 of the insertion part 22, and an end face 131 of the outer frame part 13 and an end face 231 of the outer frame part 23 are brought into contact respectively, (see FIG. 3 and FIG. 4, for a layout of the individual end faces). In this way, the core 10 and core 20 configure a frame as a whole, in which the insertion part 12 and the insertion part 22 are enclosed.

While the embodiment has been described that all of three sets, represented by the outer frame part 11 and the outer frame part 21, the insertion part 12 and the insertion part 22, and the outer frame part 13 and the outer frame part 23, were respectively brought into contact with each other, the embodiment is not limited thereto. More specifically, apart of, or all of these three sets are not always necessarily brought into direct contact. For example, a gap composed of an air layer or an insulator such as resin may be provided between the two components of each of three sets, so as to control electromagnetic characteristics of the inductor 100.

It is, however, preferable that in any one of the sets, the two components are brought into direct contact, or brought into indirect contact while placing something in between. This is because, if the two components in at least one of the three sets are brought into contact, the fixation member 60 can bind the core 10 and the core 20 on the outer circumferential side faces thereof, and so that the closed magnetic path may be fixed by tightening the fixation member 60.

The cores 10, 20 and the coil 70 configure a magnetic path M1 and a magnetic path M2. The magnetic path M2 is routed, when assumed to start from the insertion part 12, as insertion part 12→outer frame part 14→outer frame part 11→outer frame part 21→outer frame part 24→insertion part 22→insertion part 12. The magnetic path M1 is routed, when assumed to start from the insertion part 12, as insertion part 12→outer frame part 14→outer frame part 13→outer frame part 23→outer frame part 24→insertion part 22→insertion part 12. In short, both of the magnetic path M1 and the magnetic path M2 configure the closed magnetic paths.

<Fixation Member 60>

The fixation member 60 will now be described below, referring to FIG. 1, FIG. 2, FIG. 5 and FIG. 6. More specifically, positional relations among the core 10, the core 20 and the main body 50 will be made clear, and then a technique of fixing the closed magnetic path (the frame composed of the core 10 and the core 20) with the fixation member 60 will be explained.

FIG. 1 is a perspective view of the inductor 100 of the first embodiment, with the one core 10 directed to the nearer side. FIG. 2 is a perspective view of the inductor 100, with the other core 20, having been directed to the far side in FIG. 1, directed to the nearer side. FIG. 5 is a bottom view of the inductor 100. FIG. 6 is a cross-sectional view taken along line VI-VI in FIG. 5.

The main body 50 has a base part 51 which is positioned, when mounted on a board (not illustrated), between the board and the pair of magnetic members (core 10 and core 20) so as to keep the board and the pair of magnetic members apart from each other.

As described previously, the core 10 and the core 20, which configure the closed magnetic path, form a square frame enclosing therein the insertion part 12.

The fixation member 60 extends over the longitudinal direction thereof around all of four side faces of the frame, to thereby bind the frame. In this way, the relative positional shift of the main body 50 and the pair of magnetic members (core 10 and core 20) may be suppressed.

While the fixation member 60 exemplified in this embodiment extends around all of four side faces of the frame, the embodiment is not limited thereto. For example, the fixation member 60 may be bound to at least two adjoining side faces out of four side faces, and, also extends over a side face of the base part and the two side faces of the frame. This is because binding of at least two adjoining side faces is enough to suppress relative positional shift of the main body 50 and the pair of magnetic members (core 10 and core 20) in the Y-axis direction and the Z-axis direction.

The four side faces of the frame described in the previous paragraph are specifically shown in the next. A first side face is represented by a side face 141 contained in the outer circumference of the outer frame part 14 of the core 10. A second side face is represented by a side face 241 contained in the outer circumference of the outer frame part 24 of the core 20. A third side face is represented by a plane configured by combining a side face 112 contained in the outer circumference of the outer frame part 11 of the core 10, and a side face 212 contained in the outer circumference of the outer frame part 21 of the core 20. A fourth side face is represented by a plane configured by combining a side face 132 contained in the outer circumference of the outer frame part 13 of the core 10, and a side face 232 contained in the outer circumference of the outer frame part 23 of the core 20.

The fixation member 60 in this embodiment is preferably a band-like member having a long side, i.e., the first and second sides 60*a* and 60*b* shown in FIG. 1, in the longitudinal direction and a short side in the widthwise direction, and is provided with a tacky adhesive layer having tackiness. The fixation member 60 may be an adhesive tape having a tacky surface preliminarily formed thereon, or may be a band-like member used by coating thereon an adhesive, when the inductor 100 is manufactured.

When the fixation member 60 described above is used, the fixation member 60 is preferably bound to the pair of magnetic members (core 10 and core 20) and the main body 50, while placing the tacky adhesive layer in between for adhesion.

By using such fixation member 60, only a simple work (one action), such as placing the fixation member 60, will be enough to fix the pair of magnetic members and the main body 50. Since the binding force is assisted by the adhesive force, the pair of magnetic members and the main body 50 may be bound more tightly as compared with the case where they are bound only by a binding force of the fixation member 60.

The fixation member 60 may also be made of a heat shrinkable material. More specifically, the fixation member 60 has a heat shrinkage factor in the longitudinal direction larger than in the widthwise direction. The heat shrinkable material is exemplified by easily adhesive synthetic resin materials such as polyphenylene sulfide (PPS), polyvinyl chloride (PVC), and polyethylene terephthalate (PET). The fixation member 60 preferably has the melting point higher than reflow temperature of solder (for example, 240° C. or above and 250° C. or below), and can therefore fully shrink in the longitudinal direction under heating at the reflow temperature. Thus the fixation member 60 can shrink in the longitudinal direction, under heating when the inductor 100 is mounted on the board (not illustrated) using a solder by the reflow process, and thereby the fixing force between the pair of magnetic members and the main body 50 may be increased.

In the main body 50 in this embodiment, the side faces of the base part 51 are preferably recessed inwardly from the side faces of the frame, or, aligned in the same plane with the side faces of the frame.

This is because, with such configuration, even if the fixation member 60 should be brought apart from the base part 51, the hem of the fixation member 60 will not expand outward, so that the hem of the fixation member 60 may be prevented from being brought into contact with electronic components (not illustrated) arranged close to the inductor 100. This is also because, with such configuration, the tacky adhesive layer of the fixation member 60 can more readily be adhered to a portion on the frame side of the boundary between the base part 51 and the frame, so that the force of binding the frame by the fixation member 60 will effect more fully than in a configuration where the side faces of the base part 51 protrude outward from the side faces of the frame.

As described above, the main body 50 in this embodiment is configured by press-fitting the second member 40 containing the cover part 41 which covers the coil 70, onto the first member 30 containing the plurality of terminal parts 31 which are connected to the board.

The side faces of the base part 51 include first planes 321, 331 contained in the first member 30, and second planes 421 to 426 contained in the second member 40. The fixation member 60 is bound across the first planes 321, 331 and the second planes 421 to 426. In other words, as shown in FIG. 1, part of the fixation member 60 directly adjacent to the first side 60*a* of the fixation member 60 is bound across the first planes 321, 331 and the second planes 421 to 426.

Now, the terminal parts 31 are parts used when the coil 70 is electrically connected to the electrodes on the board (not illustrated), and are connected to such electrodes. As the terminal parts 31 in this embodiment, there are provided four terminal parts 311 to 314 arranged on the core 10 side (more negative side on Z-axis), and four terminal parts 315 to 318 arranged on the core 20 side (more positive side on Z-axis).

The first planes 321, 331 can be explained in further detail, as follows.

The first plane 321 is a side face of the base part 51, contained in the leg part 32 having the base ends of the terminal parts 311 to 314 embedded therein, and faced to the negative side on Z-axis. The first plane 321 is aligned nearly to the same plane with the second plane 421, and aligned to the same plane with the side face 141, or, recessed inwardly from the side face 141.

The first plane 331 is a side face of the base part 51, contained in the leg part 33 having the base ends of the terminal parts 315 to 318 embedded therein, and faced to the positive side on Z-axis. The first plane 331 is aligned nearly to the same plane with the second plane 424, and aligned to the same plane with the side face 241, or, recessed inwardly from the side face 241.

The second planes 421 to 426 can be explained in further detail, as follows.

The second plane 421 is a side face of the base part 51 faced to the negative side on Z-axis, and is positioned between the side face 141 and the first plane 321. The second plane 421 is aligned nearly to the same plane with the first plane 321, and aligned to the same plane with the side face 141, or, recessed inwardly therefrom.

The second plane 422 and the second plane 423 are side faces of the base part 51 faced to the positive side on Y-axis. The second plane 422 and the second plane 423 are recessed from the side face 132 and the side face 232, respectively.

The second plane 424 is a side face of the base part 51 faced to the positive side on Z-axis, and is positioned between the side face 241 and the first plane 331. The second plane 424 is aligned nearly to the same plane with the first plane 331, and aligned to the same plane with the side face 241 or recessed inwardly therefrom.

The second plane 425 and the second plane 426 are side faces of the base part 51 faced to the negative side on Y-axis. The second plane 425 and the second plane 426 are recessed from the side face 212 and the side face 112, respectively.

Since the core 10, the core 20 and the main body 50 are disposed according to the positional relation described above, the fixation member 60 can be bound to the individual faces as described below.

The fixation member 60 is bound, across the widthwise direction thereof, to the side face 141 of the frame, the first plane 321 and the second plane 421.

The fixation member 60 is bound, across the widthwise direction thereof, to the side face 132 and the side face 232 of the frame, the second plane 422, and the second plane 423.

The fixation member 60 is bound, across the widthwise direction thereof, to the side face 241 of the frame, the first plane 331, and the second plane 424.

The fixation member 60 is bound, across the widthwise direction thereof, to the side face 112 and side face 212 of the frame, the second plane 425, and the second plane 426.

The fixation member 60 is bound, over the longitudinal direction thereof, to the side face 141, the side face 132, the side face 232, the side face 241, the side face 212 and the side face 112 of the frame. In other words, the fixation member 60 extends around all of four side faces of the frame.

The fixation member 60 is bound, over the longitudinal direction thereof, to the first plane 321 or the second plane 421, the second plane 422, the second plane 423, the first plane 331 or the second plane 424, the second plane 425, and the second plane 426 of the base part 51. In short, the fixation member 60 extends around all of the side faces of the base part 51.

Since the fixation member 60 binds the individual faces as described above, the first member 30 and the second member 40 are prevented from shifting in the longitudinal direction of the fixation member 60 (Y-axis direction and Z-axis direction), and also from shifting in the widthwise direction of the fixation member 60 (X-axis direction).

The first plane 321, the second plane 421 and the side face 141 are aligned nearly in the same plane, so that three kinds of components (core 10, first member 30 and second member 40) are bound with each other, by the fixation member 60 across the widthwise direction thereof. The three kinds of components are therefore prevented from shifting in the Z-axis direction.

The first plane 331, the second plane 424 and the side face 241 are again aligned nearly in the same plane, so that three kinds of components (core 20, first member 30 and second member 40) are bound with each other, by the fixation member 60 across the widthwise direction thereof. The three kinds of components are therefore prevented from shifting in the Z-axis direction.

<Method of Manufacturing Inductor 100>

Next, a method of manufacturing the inductor 100 will be explained, referring to FIG. 10.

Figure 10:
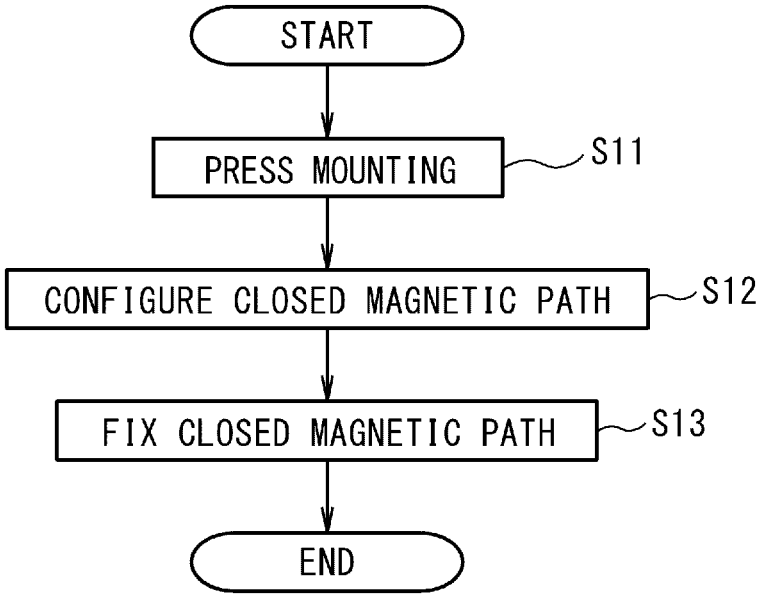
FIG. 10 is a flow chart illustrating a method of manufacturing the inductor.

FIG. 10 is a flow chart illustrating the method of manufacturing the inductor 100.

The method of manufacturing illustrated in FIG. 10 is a method of manufacturing the inductor 100 which has a pair of magnetic members (core 10 and core 20), and the main body 50 having the coil 70 configured by a wound wire. The method of manufacturing includes a step of press-fitting (S11), a step of configuring the closed magnetic path (S12), and a step of fixing the closed magnetic path (S13).

In step S11, the second member 40 is press-fitted to the first member 30, to thereby fix them with each other.

In step S12, the rod-like insertion part 12 of one magnetic member (core 10), out of the pair of magnetic members, is inserted into the coil 71. At the same time or a different time the insertion part 12 is inserted into the coil 71, the rod-like insertion part 22 of the other magnetic member (core 20), out of the pair of magnetic members, is inserted into the coil 72. In this way, the one magnetic member (core 10) and the other magnetic member (core 20) are combined to configure the closed magnetic path which includes as a part thereof the insertion parts 12, 22.

In step S13, the sheet-formed fixation member 60 is bound across the core 10, the core 20, and the main body 50, to thereby fix the core 10 and the core 20, both configuring the closed magnetic path, and to thereby fix at least one of the pair of magnetic members to the main body 50.

By this method of manufacturing, since the fixation member 60 (i) binds and fixes the core 10 to the core 20, and (ii) binds and fixes at least one of the core 10 and the core 20 to the main body 50, so that relative shift in position of these components may be suppressed. Accordingly, in the process of fixing the relative position of the core 10 and the coil 71, or, the core 20 and the coil 72, the positional shift may be suppressed in a successful manner, and the workload required for the process may be reduced.

As described previously, the main body 50 in this embodiment has a base part 51 which is positioned, when mounted on a board (not illustrated), between the board and the pair of magnetic members (core 10 and core 20) so as to keep the board and the pair of magnetic members apart from each other. The fixation member 60 in this embodiment is a band-like member having a long side in the longitudinal direction and a short side in the widthwise direction, and is provided with a tacky adhesive layer having tackiness.

Accordingly, in the step of configuring the closed magnetic path (S12), the pair of magnetic members (core 10 and core 20) may be combined to form a square frame enclosing therein the insertion parts 12, 22.

In the step of fixing the closed magnetic path (S13), (a) the frame and the base part 51 may be aligned according to a desired positional relation, with reference to at least two adjoining side faces out of four side faces of the frame, (b) the fixation member 60 may be adhered over the longitudinal direction thereof to the two faces, and, (c) the fixation member 60 may be adhered across the widthwise direction thereof to the two faces and to the side faces of the base part 51.

The processes (a), (b) and (c) in step S13 may take place in parallel, or independently in a time-series manner.

In the process (a) in step S13, the frame and the base part 51 may be aligned with reference to the both of two adjoining side faces out of all side faces of the frame, at the same time, or partially in a parallel manner. Alternatively, alignment with reference to one of two side faces, may be followed by the alignment with reference to the other.

In this process, the frame (core 10 or core 20) and the base part 51 (first member 30 or second member 40) may be moved directly by an operator or a machine, or may be moved indirectly by the binding force of the fixation member 60 kept under tension.

In the processes (b) and (c) in step S13, adhesion of the fixation member 60 in the longitudinal direction and in the widthwise direction may take place at the same time of partially in a parallel manner. Alternatively, adhesion in either one direction may be followed by adhesion in the other direction.

According to the method of manufacturing, since the side faces of the frame (core 10 or core 20) can serve as the reference for alignment, so that the individual components of the inductor 100 may be aligned into desired positions, without using any specialized jig.

While the method of manufacturing suitable for this embodiment has been described, on the premise that all of the constituents composing the inductor 100 are preliminarily assorted, the steps are not necessarily the whole steps of the method of manufacturing the inductor 100. For example, the steps described above may be preceded by a step of forming the cores 10, 20, the first member 30 and so forth, or by a step of winding the winding wire around the bobbin parts 38, 39 to thereby form the coils 71, 72.

Second Embodiment

An inductor 200 of a second embodiment will be outlined below, referring to FIG. 11.

Figure 11:
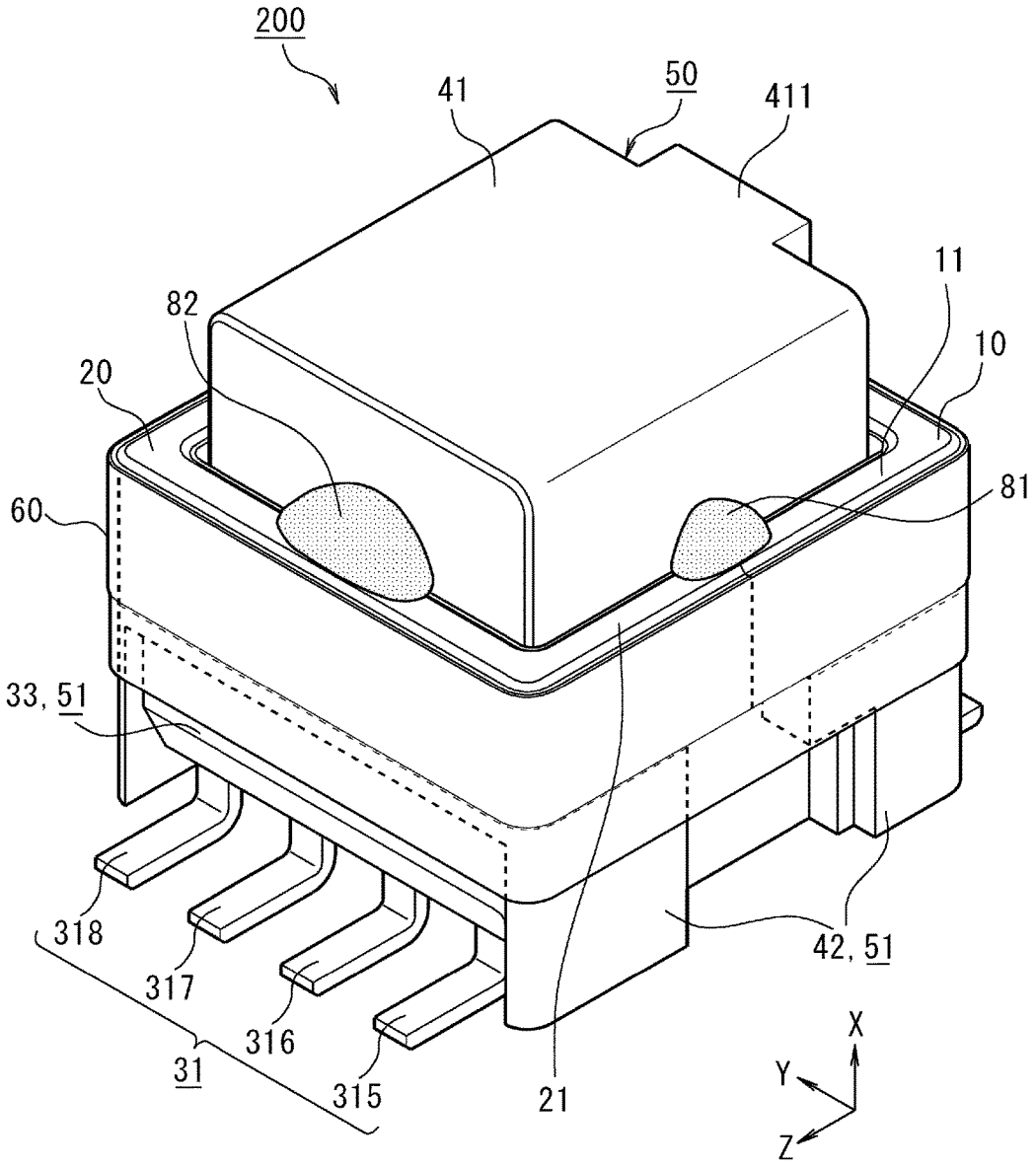
FIG. 11 is a perspective view illustrating an inductor of a second embodiment.

FIG. 11 is a perspective view illustrating the inductor 200 of the second embodiment. In more details, FIG. 11 is a perspective view of the inductor 200, with the core 20 directed to the nearer side.

In this embodiment, all components and parts, which are considered to be identical with those in the first embodiment, will be given identical names and reference numerals for the convenience of explanation.

The inductor 200 of this embodiment is different from the inductor 100 of the first embodiment, in that adhesives 81, 82 are applied at boundary positions between a part of the cover part 41 which protrudes from inside of the frame, configured to contain the core 10 and the core 20, in the direction opposite to the base part 51, and the pair of magnetic members.

In more details, the adhesive 81 is applied at the boundary position between a point where the outer frame part 11 and the outer frame part 21 come into contact, and the side face of the cover part 41 at around the point of contact. The adhesive 82 is applied to a position where the insertion part (not illustrated) of the core 20 is inserted into the main body 50.

By applying the adhesives 81, 82 in this way, the pair of magnetic members (core 10 and core 20) and the main body 50 may be fixed more tightly.

Although not illustrated here, the adhesive may also be applied to a point-symmetrical position as viewed from the point where the adhesive 81 or the adhesive 82 is applied, about the center of the pair of magnetic members (position of contact of the insertion part of the core 10 and the insertion part of the core 20). This is because the pair of magnetic members and the main body 50 may be fixed more tightly by applying the adhesive in this way.

Except for the features described above, the inductor 200 of this embodiment is same as the inductor 100 of the first embodiment. Various operations and effects in this embodiment, which are common to those in the first embodiment, will not be detailed here.

The present invention has been explained referring to a plurality of embodiments, merely for illustrative purposes. Each of the various constituents described above is not always necessarily an essential constituent, instead being omissible so long as the effect of the present invention will not be ruined, or being replaceable with the other constituent which functions or acts in the same way.

For example, the paragraphs above have described an exemplary case where the winding wire was wound around the bobbin part 38 and the bobbin part 39 to form the coil 71 and the coil 72, respectively, the main body 50 does not always necessarily have portions equivalent to the bobbin part 38 and the bobbin part 39. More specifically, so long as the winding wire which forms the coil is covered with an insulating material, the winding wire may be wound directly around the cores 10, 20 to form the coil.

While the paragraphs above have described an exemplary case where the coil 70 is covered with the cover part 41, the cover part 41 is not essential, and instead the coil 70 may stay exposed.

Each of the various constituents of the present invention is not always necessarily an independent something that exists, instead allowing that a plurality of constituents are configured to give a single constituent; that a single constituent is formed by a plurality of divisional constituents; that a certain constituents is a part of other constituent; and that a part of a certain constituent overlaps with a part of other constituent.

For example, while both embodiments explained above dealt with the exemplary cases where the main body 50 has two coils (coil 71 and coil 72), the main body 50 may have at least one coil, or the coil 71 and the coil 72 may be electrically connected to give a single coil.

According to the present invention, there is provided an inductor which contributes to improve the productivity, and a method of manufacturing such inductor.

It is apparent that the present invention is not limited to the above embodiment, and may be modified and changed without departing from the scope and spirit of the invention.

This embodiment also embraces the technical spirits below:

(1) An inductor which includes a pair of magnetic members, and a main body having a coil configured by a wound wire, a rod-like insertion part of one magnetic member, out of the pair of magnetic members, being inserted into the coil, the one magnetic member being combined with the other magnetic member to configure a closed magnetic path, and, the closed magnetic path including as a part thereof the insertion part, the inductor further includes a sheet-formed fixation member, the fixation member being bound across the one magnetic member and the other magnetic member and the main body, to thereby fix the one magnetic member to the other magnetic member, both configuring the closed magnetic path, and to thereby fix at least one of the pair of magnetic members to the main body.

(2) The inductor according to (1), wherein the main body has a base part which is positioned, when mounted on a board, between the board and the pair of magnetic members so as to keep the board and the pair of magnetic members apart from each other, the pair of magnetic members, which configure the closed magnetic path, form a square frame enclosing therein the insertion part, and the fixation member is bound to at least two adjoining side faces out of four side faces of the frame, and, also extends over a side face of the base part and the two side faces of the frame.

(3) The inductor according to (2), wherein the fixation member is a band-like member having a long side in the longitudinal direction and a short side in the widthwise direction, and is provided with a tacky adhesive layer having tackiness, and the fixation member is bound to the pair of magnetic members and the main body, while placing the tacky adhesive layer in between for adhesion.

(4) The inductor according to (3), wherein the fixation member extends over the longitudinal direction thereof around all of four side faces of the frame, to thereby bind the frame.

(5) The inductor according to any one of (2) to (4), wherein the side faces of the base part bound with the fixation member are recessed inwardly from the side faces of the frame, or, aligned in the same plane with the side faces of the frame.

(6) The inductor according to any one of (2) to (5), wherein the main body is configured by press-fitting a second member containing a cover part which covers the coil, onto a first member containing a plurality of terminal parts which are connected to the board, the side faces of the base part bound to the fixation member include a first plane contained in the first member, and a second plane contained in the second member, and the fixation member is bound across the first plane and the second plane.

(7) The inductor according to (6) dependent to (3), wherein the fixation member is bound, across the widthwise direction thereof, to the side faces of the frame, the first plane and the second plane.

(8) The inductor according to (6) or (7), wherein the first member contains a hollow tubular article having the coil wound therearound, and having the insertion part inserted therein, the hollow tubular article is flanged at the end part thereof, the second member has a rib which is formed on the inner wall of the cover part so as to oppose to the end part, and so as to protrude from the inner wall towards the end part, and, the second member is press-fitted along the end part so as to bring the end part into close contact with the rib.

(9) The inductor according to (8), wherein the end part contains an opening having the insertion part inserted therein, the rib extends nearly linearly along the inner wall of the cover part, and the rib extends at a position which falls outside the opening at the end part, when viewed whichever from the direction of press-fitting of the second member, or from the direction normal to the direction of press-fitting.

(10) The inductor according to any one of (6) to (9), wherein an adhesive is coated on a boundary position between a part of the cover part which protrude from inside of the frame towards the opposite side of the base part, and the pair of magnetic members.

(11) A method of manufacturing an inductor which has a pair of magnetic members, and a main body having a coil configured by a wound wire, the method includes:

configuring a closed magnetic path, by inserting a rod-like insertion part of one magnetic member, out of the pair of magnetic members, into the coil, and combining the one magnetic member with the other magnetic member to configure a closed magnetic path which includes as a part thereof the insertion part; and fixing the closed magnetic path, by binding a sheet-formed fixation member across the one magnetic member and the other magnetic member and the main body, to thereby fix the one magnetic member to the other magnetic member, both configuring the closed magnetic path, and to thereby fix at least one of the pair of magnetic members to the main body.

(12) The method of manufacturing an inductor according to (11), wherein the main body has a base part which is positioned, when mounted on a board, between the board and the pair of magnetic members so as to keep the board and the pair of magnetic members apart from each other, the fixation member is a band-like member having a long side in the longitudinal direction and a short side in the widthwise direction, and is provided with a tacky adhesive layer having tackiness, in the step of configuring the closed magnetic path, the pair of magnetic members are combined to form a square frame enclosing therein the insertion part, and in the step of fixing the closed magnetic path, the frame and the base part are aligned according to a desired positional relation, with reference to at least two adjoining side faces out of four side faces of the frame, the fixation member is adhered over the longitudinal direction thereof to the two faces, and, the fixation member is adhered across the widthwise direction thereof to the two faces and to the side face of the base part.

What is claimed is:

1. An inductor comprising:

a main body, the main body having a coil that is configured by a wound wire so that the coil has an opening at an inside thereof;

first and second magnetic members, the first magnetic member having a first end, the second magnetic member having a second end, the first magnetic member being magnetically secured to the second magnetic member at the first and second ends, the first and second magnetic members being located at both sides of the coil so as to laterally surround part of the coil by being magnetically secured at the first and second ends, the first magnetic member having a rod-shaped projection, the rod-shaped projection being inserted into the opening of the coil so as to form a closed magnetic path with the second magnetic member when the first and second magnetic members laterally surround the part of the coil; and an adhesive tape on which an adhesion is provided, the adhesive tape extending in a longitudinal direction so that the adhesive tape has first and second sides opposite to each other along the longitudinal direction, wherein the adhesive tape is continuously provided on an area including the first and second ends and part of the main body so that the adhesive tape fixes the first and second magnetic members to each other and fixes one of the first and second magnetic members to the part of the main body when the first side of the adhesive tape is located on the part of the main body, wherein the main body has a base that is located between a board on which the inductor is mountable and the first and second magnetic members, the main body is configured with a second member containing a cover which covers the coil and a first member containing a plurality of terminals which are connectable to the board, and parts of the first and second members configure the base, part of the base on which the adhesive tape is fixed is configured by a first plane of the first member and a second plane of the second member, and the adhesive tape is provided across the first plane and the second plane so as to fix the first and second members.

2. The inductor according to claim 1, wherein the first magnetic member further has a third end, and the second magnetic member further has a fourth end, when the first magnetic member is magnetically secured to the second magnetic member at both of a pair of the first end and the second end and a pair of the third end and the fourth end so as to surround the coil, the first and second magnetic members configure a square-shaped frame in a plan view, the square-shaped frame has first through fourth side surfaces, the first side surface includes the first and second ends, the second side surface includes the third and fourth ends, and the third and fourth side surfaces are located between the first and second side surfaces, and the adhesive tape is continuously provided at least on the first side surface and the third side surface adjacent to each other of the square-shaped frame and the part of the base so as to fix the first and second magnetic members to the part of the base of the main body.

3. The inductor according to claim 2, wherein the adhesive tape is continuously provided on the first through fourth side surfaces of the square-shaped frame so as to bind the first and second magnetic members together.

4. The inductor according to claim 2, wherein the part of the base on which the adhesive tape is provided is recessed inwardly from the first side surface of the square-shaped frame, or the part of the base on which the adhesive tape is provided and the first side surface of the square-shaped frame are coplanar.

5. The inductor according to claim 1, wherein the first and second members are connected by a press-fitting member.

6. The inductor according to claim 2, wherein each of the first and third side surfaces of the square-shaped frame has upper and lower edges, the upper edge is closer to a top of the second member than the lower edge, and the second side of the adhesive tape is located along the upper edge of each of the first and third side surfaces, and the first side of the adhesive tape is located on the first and second planes.

7. The inductor according to claim 5, wherein the first member has a hollow tubular member having outer and inner surfaces, the coil is wound on the outer surface, and the rod-shaped projection is inserted into an inside of the inner surface which configures the opening of the coil, a flange is provided at an end of the hollow tubular member, a rib is formed on an inner surface of the cover of the second member, the rib faces the end of the hollow tubular member, and the rib is projected from the inner surface of the cover toward the end of the hollow tubular member, and the end of the hollow tubular member and the rib configure the press-fitting member, and the second member is press-fitted onto the first member along the end of the hollow tubular member so as to bring the end of the hollow tubular member into close contact with the rib.

8. The inductor according to claim 7, wherein the rib extends nearly linearly along the inner surface of the cover, and the rib extends at a position which falls outside the opening of the coil, when viewed from a press-fitting direction of the second member and from a direction perpendicular to the press-fitting direction.

9. The inductor according to claim 5, wherein each of the first and third side surfaces of the square-shaped frame has upper and lower edges, the upper edge is closer to a top of the second member than the lower edge, and a cover adhesive is coated on a boundary between part of the cover of the second member and the upper edge of the square-shaped frame configuring the first and second magnetic members.

10. The inductor according to claim 1, wherein the adhesive tape is made of a heat shrinkable material that shrinks by applying heat, and a first shrinking ratio of the adhesive tape in the longitudinal direction is larger than a second shrinking ratio of the adhesive tape in a direction perpendicular to the longitudinal direction.

11. A method of manufacturing an inductor, the method comprising:

providing the inductor with:

a main body, the main body having a coil that is configured by a wound wire so that the coil has an opening at an inside thereof;

first and second magnetic members, the first magnetic member having a first end, the second magnetic member having a second end, the first magnetic member having a rod-shaped projection; and an adhesive tape on which an adhesion is provided, the adhesive tape extending in a longitudinal direction so that the adhesive tape has first and second sides opposite to each other along the longitudinal direction;

configuring a closed magnetic path by:

placing the first and second magnetic members at both sides of the coil so as to laterally surround part of the coil by being magnetically secured at the first and second ends; and inserting the rod-shaped projection into the opening of the coil so as to form the closed magnetic path with the second magnetic member when the first and second magnetic members laterally surround the part of the coil; and continuously providing the adhesive tape on an area including the first and second ends and part of the main body so that the adhesive tape fixes the first and second magnetic members to each other and fixes one of the first and second magnetic members to the part of the main body when the first side of the adhesive tape is located on the part of the main body, wherein the main body has a base that is located between a board on which the inductor is mountable and the first and second magnetic members, the main body is configured with a second member containing a cover which covers the coil and a first member containing a plurality of terminals which are connectable to the board, and parts of the first and second members configure the base, part of the base on which the adhesive tape is fixed is configured by a first Diane of the first member and a second plane of the second member, and the adhesive tape is provided across the first plane and the second plane so as to fix the first and second members.

12. The method of manufacturing an inductor according to claim 11, wherein in the configuring of the closed magnetic path, the first magnetic member further has a third end, the second magnetic member further has a fourth end, and when the first magnetic member is magnetically secured to the second magnetic member at both of a pair of the first end and the second end and a pair of the third end and the fourth end so as to surround the coil, the first and second magnetic members configure a square-shaped frame in a plan view, the square-shaped frame has first through fourth side surfaces, the first side surface includes the first and second ends, the second side surface includes the third and fourth ends, and the third and fourth side surfaces are located between the first and second side surfaces, and in the continuously providing of the adhesive tape, the adhesive tape is continuously provided to at least the first side surface and the third side surface adjacent to each other of the square-shaped frame and part of the base so as to fix the first and second magnetic members and the part of the base of the main body.

* * * * *